US006281639B1

(12) United States Patent
Suzuki et al.

(10) Patent No.: US 6,281,639 B1
(45) Date of Patent: Aug. 28, 2001

(54) COLD CATHODE DISCHARGE LAMP LIGHTING CIRCUIT

(75) Inventors: Shinichi Suzuki; Koichiro Suzuki; Masayuki Ota, all of Iwata-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 09/495,173

(22) Filed: Feb. 1, 2000

(30) Foreign Application Priority Data

Aug. 20, 1999 (JP) ..... 11-233906

(51) Int. Cl.[7] ..... G05F 1/00

(52) U.S. Cl. ..... 315/291; 315/209 R; 315/DIG. 4; 315/DIG. 7

(58) Field of Search ..... 315/209 R, 224, 315/291, 307, 244, DIG. 4, DIG. 7; 363/133, 98, 56, 23

(56) References Cited

U.S. PATENT DOCUMENTS

| | | | | |
|---|---|---|---|---|
| 5,212,428 | | 5/1993 | Sasaki et al. | 315/308 |
| 5,272,327 | * | 12/1993 | Mitchell et al. | 250/205 |
| 5,420,779 | * | 5/1995 | Payne | 363/56 |
| 5,430,641 | * | 7/1995 | Kates | 363/133 |
| 6,011,360 | * | 1/2000 | Gradzki et al. | 315/244 |

* cited by examiner

*Primary Examiner*—Haissa Philogene
(74) *Attorney, Agent, or Firm*—Oliff & Berridge, PLC

(57) ABSTRACT

To reduce a change in an electric current flowing through a cold cathode discharge lamp caused by a change in power source voltage. There is provided a cold cathode discharge lamp lighting circuit, in which a secondary high voltage of a transformer 13 is changed by controlling an oscillating period of a ROYER oscillating circuit 12 by a duty ratio of a PWM signal, to thereby control an amount of the electric current flowing through a cold cathode discharge lamp 11. In this lighting circuit, a resistor Rx is additionally connected between an inversion input terminal of a comparator X4 for generating the PWM signal and a power source, and a power source voltage divided by resistors Rx and R20 is inputted to the inversion input terminal. Thus, when the power source voltage is changed in an increase direction, an oscillating voltage is increased and the electric current flowing through the cold cathode discharge lamp begins to increase. However, since a voltage inputted to the comparator X4 through the resistor Rx is increased, an H (high voltage) period of the PWM signal is shortened and the oscillating period of the ROYER oscillating circuit is shortened, so that the electric current flowing through the cold cathode discharge lamp is reduced. The change in the electric current caused by the change in the power source voltage is reduced by this operation in a reverse direction.

3 Claims, 8 Drawing Sheets

COLD CATHODE DISCHARGE LAMP LIGHTING CIRCUIT

BACKGROUND OF THE INVENTION

1. Field of the Invention

The present invention relates to a lighting circuit of a cold cathode discharge lamp, and more specifically, to a circuit for adjusting luminance of the cold cathode discharge lamp by a duty light adjusting system.

2. Description of the Related Art

FIG. 5 is a schematic constructional view showing one mode of a lighting circuit of a cold cathode discharge lamp in which luminance is controlled by a duty light adjusting system.

As shown in this figure, a high frequency voltage (about 60 kHz) generated by a ROYER oscillating circuit 12 is increased by a transformer 13 and the cold cathode discharge lamp 11 is lighted by this increased high voltage (from 600 to 1600 V). In the lighting circuit of the cold cathode discharge lamp having such a circuit construction, an oscillating operation of the ROYER oscillating circuit is normally turned on/off every constant period and a ratio of a turning-on period to the constant period, i.e., a duty ratio of the oscillating operation of the ROYER oscillating circuit is changed by a PWM (Pulse Width Modulation) circuit 17 so that luminance of the cold cathode discharge lamp is adjusted. In the mode shown in FIG. 5, a luminance adjusting waveform 16 of H/L (High state/Low state) outputted from an IC (comparator) X4 of the PWM circuit 17 is inputted to a switching circuit 14 and the operation of the ROYER oscillating circuit 12 is controlled by an output signal from this switching circuit 14. The duty ratio of the luminance adjusting waveform 16 of the cold cathode discharge lamp 11 is controlled by the magnitude of a light adjusting signal voltage inputted to an inversion input terminal of the comparator X4.

FIG. 6 shows a voltage waveform inputted to an input terminal of the comparator X4 and a voltage waveform outputted from an output terminal of this comparator.

A triangular wave voltage Va is inputted to a non-inversion input terminal of the comparator X4 and light adjusting signal voltages 18 (Vb1, Vb2, Vb3) are inputted to the inversion input terminal of the comparator X4. Rectangular wave voltages Vo1, Vo2, Vo3 corresponding to these light adjusting signal voltages Vb1, Vb2, Vb3 are respectively outputted from the output terminal of the comparator. For example, when the light adjusting signal voltage Vb1 is inputted to the inversion input terminal, this light adjusting signal voltage Vb1 and the triangular wave voltage Va inputted to the non-inversion input terminal are compared with each other. A voltage level of the output terminal is set to a high (H) state in a period in which the triangular wave voltage Va is higher than the light adjusting signal voltage Vb1. In contrast to this, the voltage level of the output terminal is set to a low (L) state in a period in which the triangular wave voltage Va is lower than the light adjusting signal voltage Vb1. Namely, the rectangular wave voltage Vo1 is outputted from the output terminal. Similarly, when light adjusting signal voltages Vb2, Vb3 are inputted to the inversion input terminal, light adjusting signal voltages Vb2, Vb3 are respectively compared with the triangular wave voltage Va, and rectangular wave voltages Vo2, Vo3 are respectively outputted from the output terminal.

Thus, a PWM signal varying a ratio of the high (H) period to the low (L) period in one cycle depending on the magnitude of a light adjusting signal voltage is outputted, and the high (H) period is lengthened as the light adjusting signal voltage is reduced. This output voltage is inputted to a transistor Q1 of the switching circuit 14, turns on transistors Q1 and Q2 during the high (H) period and makes the ROYER oscillating circuit 12 start oscillating operation, so that a high frequency voltage is increased by the transformer 13 and is applied to the cold cathode discharge lamp 11. Luminance of the cold cathode discharge lamp 11 is increased as the light adjusting signal voltage is reduced, i.e., as a duty ratio of output waveforms is increased. The duty ratio of the PWM signal is normally set such that this duty ratio varies in a range from 10 to 100% when the light adjusting signal voltage varies from 0 to 5 V.

FIG. 7 is a constructional view showing a conventional example of the lighting circuit of the cold cathode discharge lamp using the duty light adjusting system.

A ROYER oscillating circuit 12 is a voltage resonance type circuit constructed by transistors Q3, Q4, a capacitor C2 and a transformer (T1) 13. As mentioned above, when the transistors Q1, Q2 of the switching circuit 14 are turned on, a direct current bias is applied to the transistors Q3, Q4 of the ROYER oscillating circuit 12 from a DC power source (12 V) through the transistor Q2 and a resistor R8 so that the ROYER oscillating circuit 12 is oscillated. In this example, an oscillating frequency of the ROYER oscillating circuit 12 is set to 60 kHz and a secondary voltage of the transformer 13 is increased such that an alternating voltage from about 600 to 1600 $V_{P\text{-}P}$ is generated on a secondary side of the transformer 13.

The triangular wave voltage Va inputted to the non-inversion input terminal of the comparator X4 that constitutes the PWM circuit 17 is generated by operational amplifiers X2, X3. A rectangular wave voltage is first generated by positively feeding an output voltage of the operational amplifier X2 back to a non-inversion input terminal through a resistor R14. Zener diodes ZD2, ZD3 between the output terminal and an inversion input terminal of the operational amplifier X2 are connected to set a wave height value of the rectangular wave voltage to a constant value. The rectangular wave voltage, that is, the output voltage of the operational amplifier X2 is inputted to an inversion input terminal of the operational amplifier X3. The operational amplifier X3 forms an integrator and is fed back from an output terminal to an inversion input terminal through a capacitor C6. Thus, the inputted rectangular wave voltage is integrated and is outputted from the output terminal of the operational amplifier X3 as a triangular wave voltage of the same frequency as the rectangular wave voltage. A frequency of the triangular wave voltage is normally set to from 100 to 600 Hz. A three-terminal regulator X1 is used as a power source for supplying a power voltage to the above operational amplifiers X2, X3 and the comparator X4. The power source voltage can be stably supplied irrespective of a change in the power source voltage (12 V) by using the three-terminal regulator X1, so that a change in the PWM signal voltage can be reduced.

However, due to its limited performance, the power source voltage would vary by about ±10%. Accordingly, when the power source voltage (12 V) varies by ±10% in the above conventional example, a primary voltage of the transformer 13 is also varied by ±10%. As a result, the increased secondary voltage of the transformer 13 is varied (by ±10%), so that an electric current flowing through the cold cathode discharge lamp 11 is also changed and so is the luminance.

Therefore, a circuit of the following system has been used to prevent this change in luminance.

FIG. 8 is a view showing the construction of a circuit using a DC/DC converter 20 to reduce the change in luminance caused by the change in the power source voltage.

A PWM signal voltage outputted from a comparator X4 is transmitted to a transistor Q1. Thus, transistors Q1, Q2 are turned on and a power source voltage is supplied to operational amplifiers X5, X6. A voltage proportional to an electric current flowing through the cold cathode discharge lamp is applied to both ends of a resistor R1. This voltage is rectified and smoothed by a diode D1 and a capacitor C9 and is applied to an inversion input terminal of the operational amplifier X6. The applied voltage is compared with a reference voltage Vref inputted to a non-inversion input terminal of the operational amplifier X6. An output voltage of the operational amplifier X6 is inputted to an inversion input terminal of the operational amplifier X5. On the other hand, a triangular wave voltage (normally ranging from 100 to 300 kHz) is inputted to a non-inversion input terminal of the operational amplifier X5, so that a PWM signal is outputted from an output terminal of the operational amplifier X5.

Transistors Q5 and Q6 are turned on during an H (high voltage) period of this PWM signal and a voltage is applied to a ROYER oscillating circuit so that an oscillating operation of the ROYER oscillating circuit is performed. Thus, an electric current flows through the cold cathode discharge lamp. Namely, as the electric current flowing through the cold cathode discharge lamp 11 is reduced and a voltage applied to the resistor R1 is reduced, the high (H) period of the PWM signal outputted from the operational amplifier X5 is lengthened (a duty ratio is increased) to elongate an oscillating period of the ROYER oscillating circuit 12. In contrast to this, conversely, when the electric current flowing through the cold cathode discharge lamp 11 is increased, the high (H) period is shortened (the duty ratio is reduced) to shorten the oscillating period of the ROYER oscillating circuit 12. Thus, the electric current flowing through the cold cathode discharge lamp becomes an approximately constant value even when the power voltage is changed.

However, there are the following defects when the DC/DC converter is used to reduce influences caused by the change in the power source voltage.

Power consumption of the DC/DC converter circuit is large and is increased by about 10% in comparison with the power consumption when the DC/DC converter circuit is not used. Further, cost of the lighting circuit is increased accompanying increase in the number of parts, and shortening of MTBF (mean time between failure), i.e., a reduction in reliability is caused. Furthermore, such a construction is contrary to a recent technical tendency of downsizing.

SUMMARY OF THE INVENTION

The present invention has been made in view of the above problems, and therefore an object of the present invention is to provide a lighting circuit of a cold cathode discharge lamp in which a change in an electric current flowing through the cold cathode discharge lamp caused by a change in power source voltage is reduced and the number of parts of an added circuit and an increase in power consumption are restrained, and which is compact, manufactured at low cost and has excellent reliability.

As means for obtaining the object, according to a first aspect of the present invention, there is provided a cold cathode discharge lamp lighting circuit comprising: a circuit for generating a pulse width modulation signal in accordance with a light adjusting signal level; a switching circuit turned on and off by the pulse width modulation signal; a ROYER oscillating circuit oscillated during a turning-on period of the switching circuit; a transformer for increasing the voltage of an output of the ROYER oscillating circuit; and a cold cathode discharge lamp lighted by the output voltage of the transformer, characterized in that the circuit for generating the pulse width modulation signal comprises a comparator circuit having a non-inversion input terminal to which a triangular wave voltage is applied and an inversion input terminal to which voltage provided by superposing a light adjusting signal voltage and a divided power source voltage is applied.

According to a second aspect of the present invention, the cold cathode discharge lamp lighting circuit is characterized in that the inversion input terminal of the comparator circuit is connected to a power source through a resistor.

According to a third aspect of the present invention, the cold cathode discharge lamp lighting circuit is characterized in that the voltage applied to the inversion input terminal of the comparator circuit is a voltage provided by superposing the light adjusting signal voltage and a voltage provided by amplifying a variation of the power source voltage.

According to the present invention, in the lighting circuit for controlling an electric current flowing through the cold cathode discharge lamp by controlling an oscillating period of the ROYER oscillating circuit with a PWM signal, a variation of the power source voltage is inputted to the input terminal of the comparator circuit for generating the PWM signal and a duty ratio of the PWM signal is changed to an amount of the electric current of the cold cathode discharge lamp changed by the change in the power source voltage. Thus, the electric current is changed in a direction reverse to a change direction of the electric current of the cold cathode discharge lamp caused by the above change in the power source voltage. The change in the electric current flowing through the cold cathode discharge lamp is reduced by control in this revere direction.

DESCRIPTION OF THE PREFERRED EMBODIMENTS

Embodiments of a cold cathode discharge lamp lighting circuit in accordance with the present invention will next be described with reference to the accompanying drawings.

Figure 1:
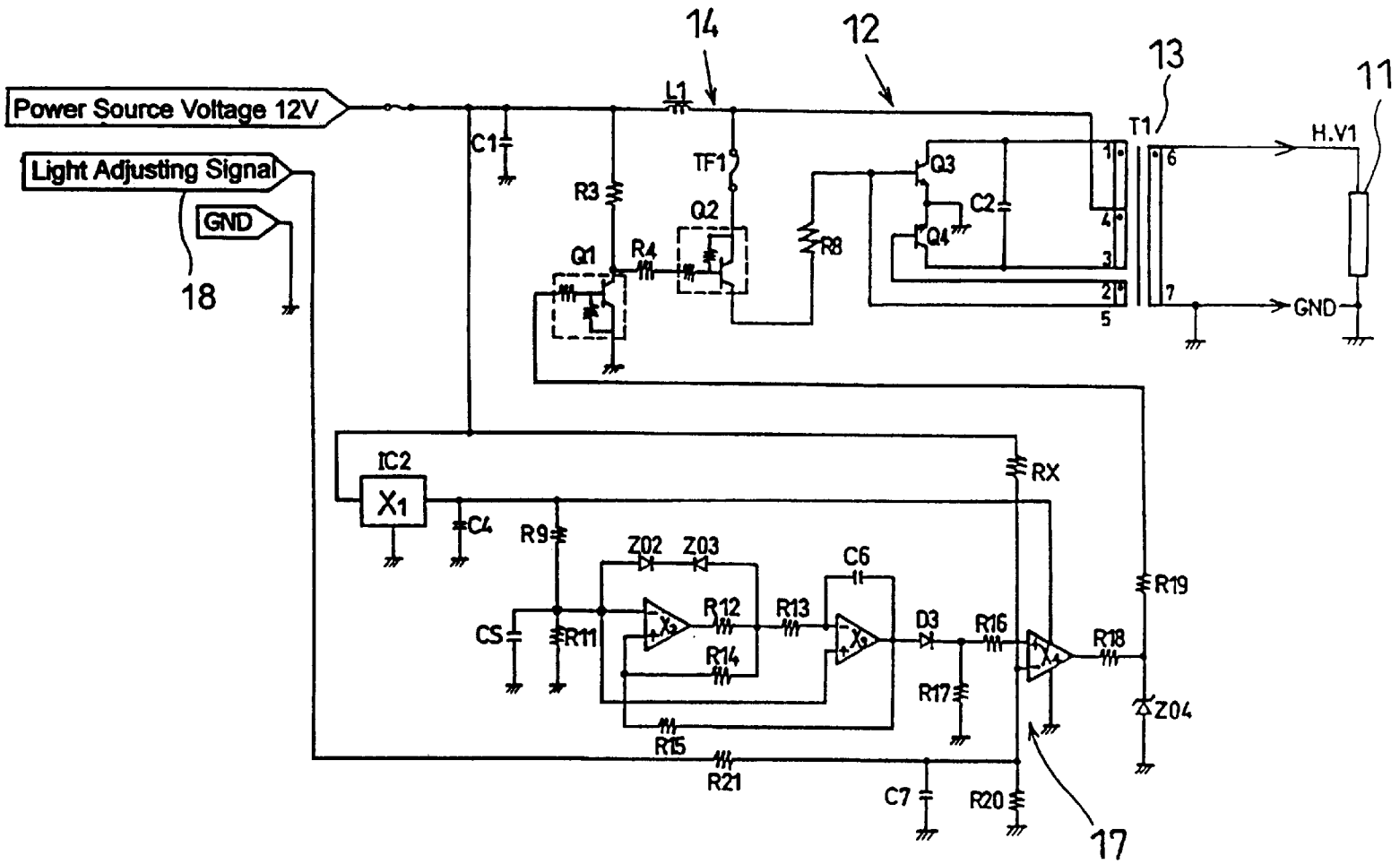
FIG. 1 is a view showing one embodiment of a cold cathode discharge lamp lighting circuit in accordance with the present invention.
Figure 7:
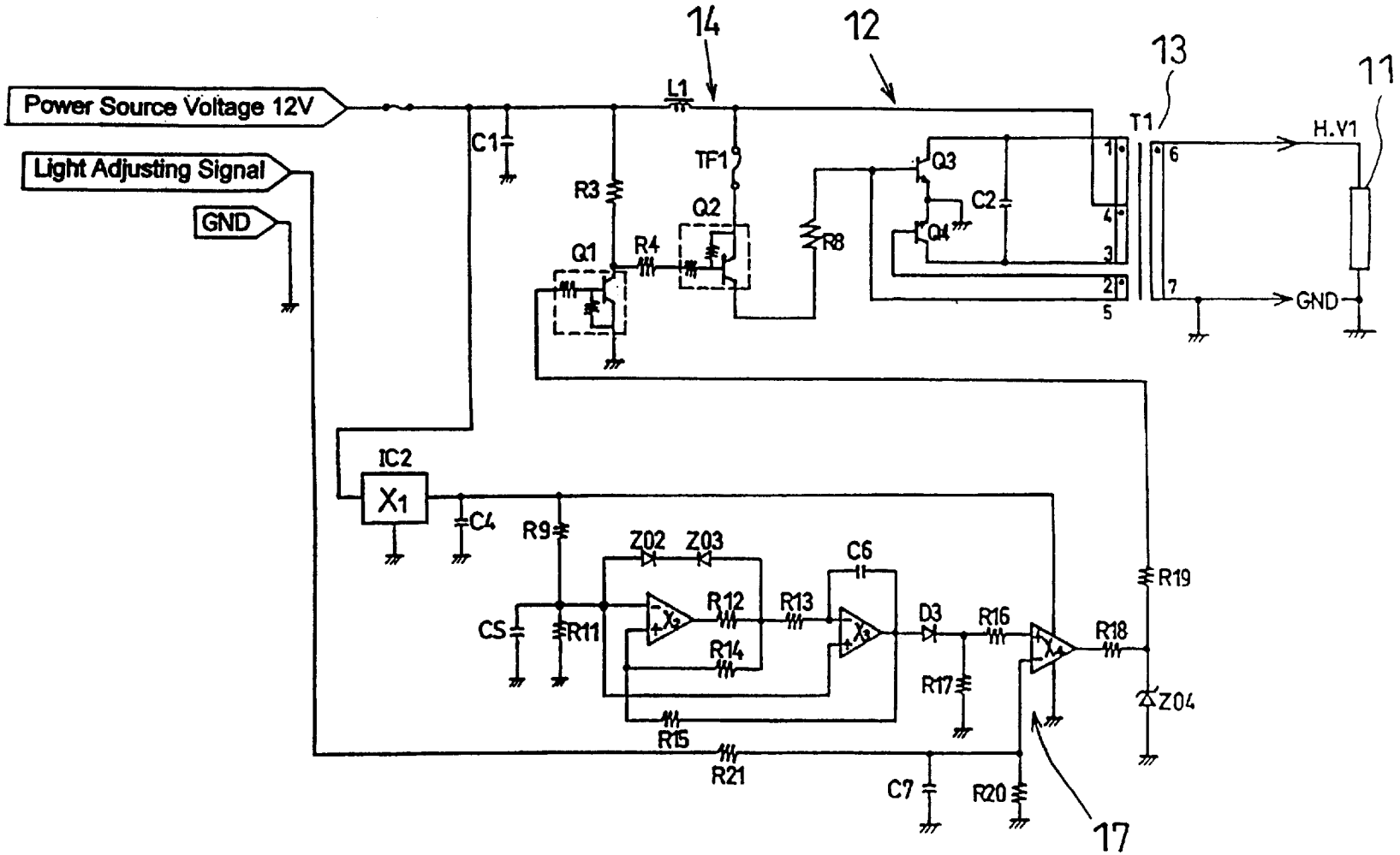
Fig.7 Prior Art
FIG. 7 is a view showing a conventional example of a lighting circuit of a cold cathode discharge lamp using the duty light adjusting system.
Figure 8:
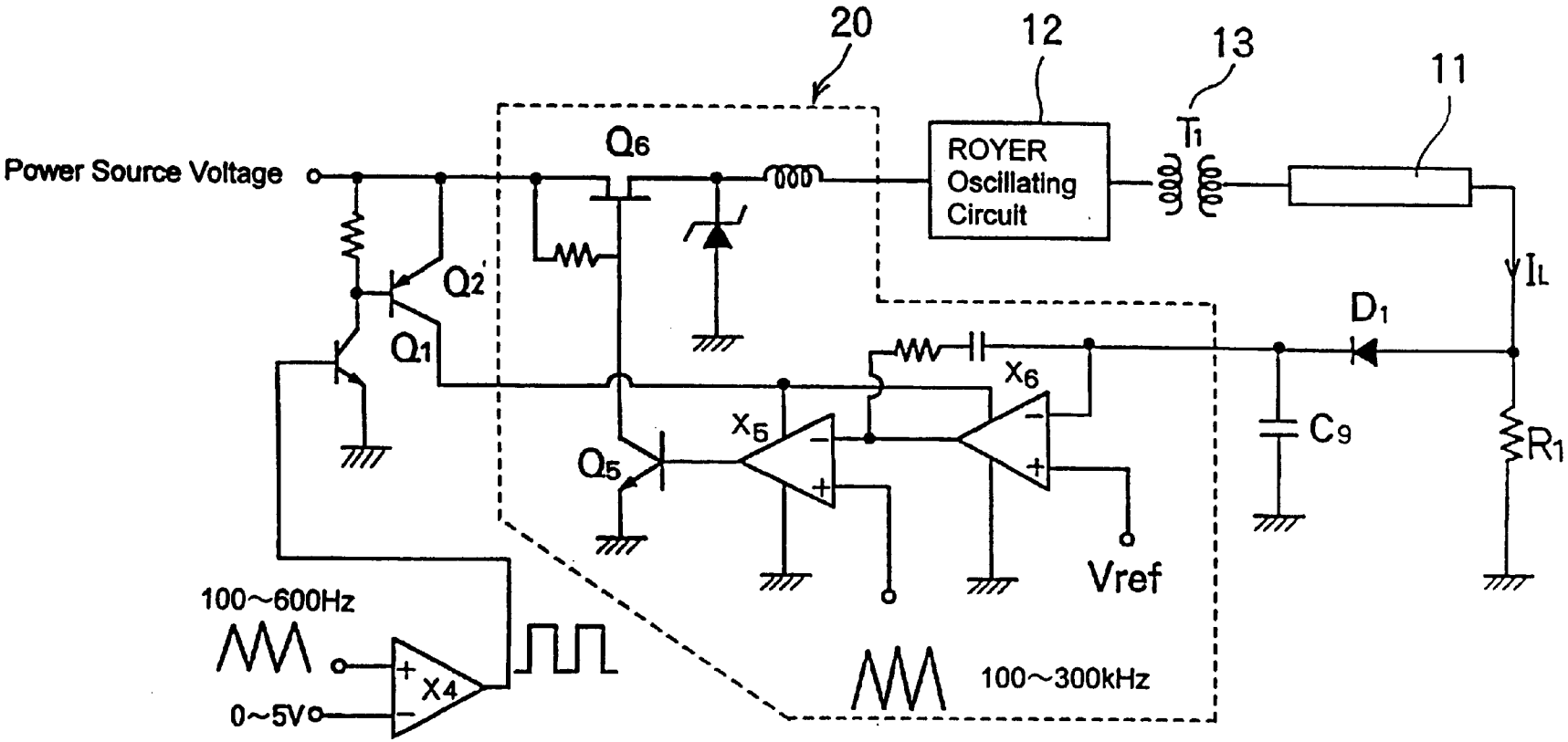
Fig.8 Prior Art
FIG. 8 is a view showing a conventional example of a circuit system for reducing the change in an electric current flowing through the cold cathode discharge lamp.

FIG. 1 is a circuit diagram in which a resistor Rx is additionally connected between a power source (12 V) and an inversion input terminal of a comparator X4 to reduce a change in an electric current flowing through the cold cathode discharge lamp caused by a change in power source voltage (12 V). The rest of the circuit constitution is the same as the conventional example shown in FIG. 7 and a basic operation of the lighting circuit is also the same as the conventional example. Therefore, a detailed explanation of these portions is omitted here in the following description.

As shown in FIG. 1, a triangular wave voltage Va generated in operational amplifiers X2, X3 is inputted to a non-inversion input terminal of the comparator X4. This triangular wave voltage Va is compared with a voltage inputted to the inversion input terminal and is outputted as a PWM signal from an output terminal of the comparator X4. An H (high voltage) period of the PWM signal is shortened as the magnitude of a voltage inputted to the inversion input terminal is increased. This high period is lengthened as this voltage is reduced. Namely, an oscillating operation period of a ROYER oscillating circuit can be controlled by changing the magnitude of the voltage inputted to the inversion input terminal so that the amount of an electric current flowing through the cold cathode discharge lamp can be changed.

In this embodiment, a light adjusting signal voltage 18 and a voltage provided by dividing a power source voltage (12 V) by resistors Rx and R20 are superposed to the inversion input terminal of the comparator X4. Accordingly, when the power source voltage (12 V) is changed and increased, the partial voltage divided by the above resistors Rx and R20 and inputted to the inversion input terminal of the comparator X4 is increased in proportion to the change in the power source voltage (12 V), so that a duty ratio of the PWM signal is reduced and the oscillating period of the ROYER oscillating circuit 12 is shortened. Thus, the electric current flowing through the cold cathode discharge lamp 11 is reduced. However, in contrast to this, when the power source voltage (12 V) is increased, an oscillating voltage of the ROYER oscillating circuit on the primary side of a transformer 13 is increased to accordingly increase a secondary voltage of the transformer. Thus, the electric current flowing through the cold cathode discharge lamp 11 is increased. As a result, a change in an average turning-on electric current flowing through the cold cathode discharge lamp 11 is reduced. When the power source voltage (12 V) is reduced, conversely, the oscillating voltage of the ROYER oscillating circuit 12 is reduced, but the oscillating period by the PWM signal is lengthened. Therefore, similar to the case of the increase in the power source voltage, the change in the average turning-on electric current flowing through the cold cathode discharge lamp 11 is reduced.

Figure 2:
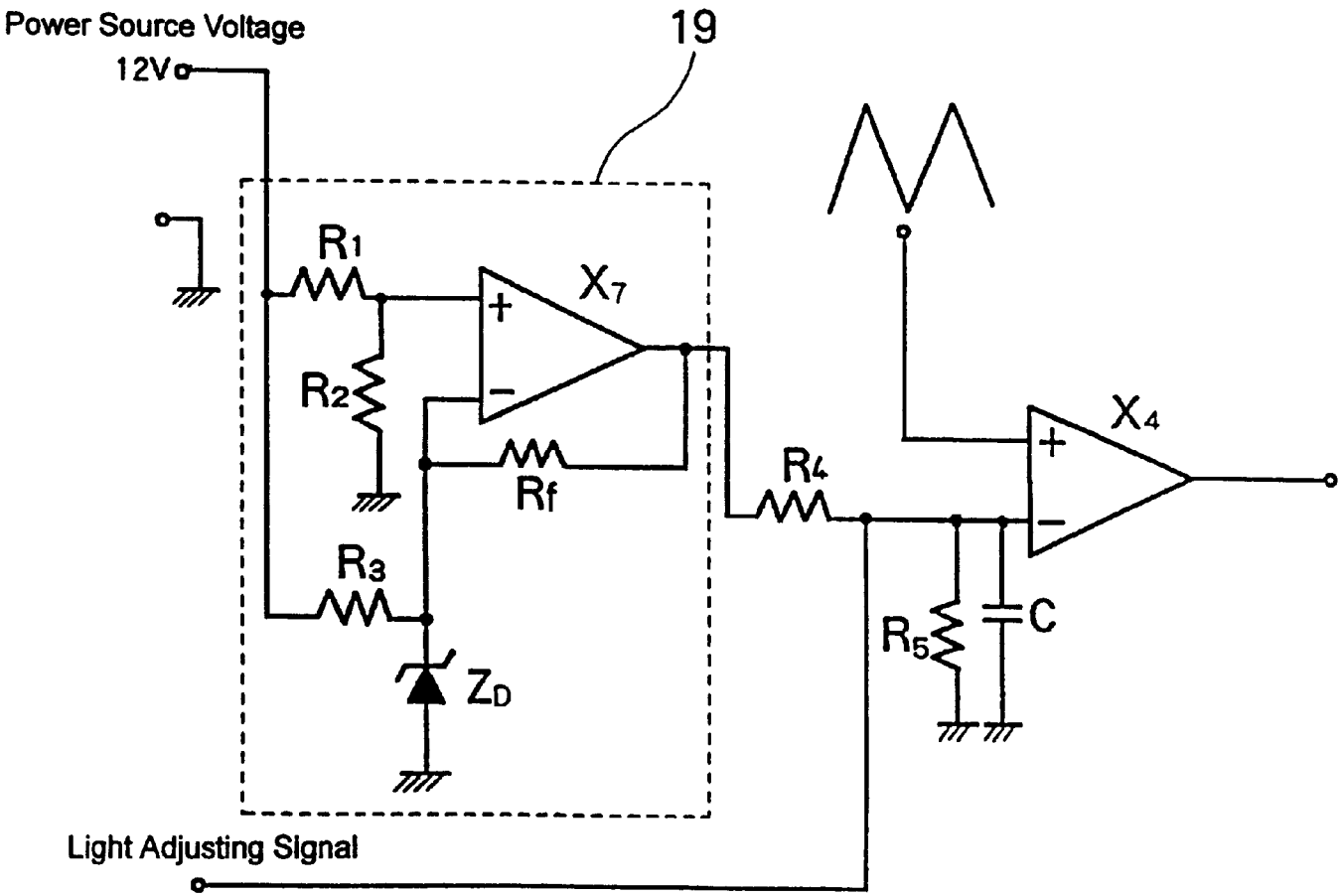
FIG. 2 is a view showing another embodiment of the cold cathode discharge lamp lighting circuit in accordance with the present invention.

FIG. 2 shows another embodiment of the present invention. In this embodiment, in order to reduce the change in the electric current flowing through the cold cathode discharge lamp caused by the change in the power source voltage (12 V), a variation of the power source voltage (12 V) is amplified by an amplifying circuit 19, and this amplified variation is superposed on a light adjusting signal voltage and is inputted to the inversion input terminal of the comparator X4. Namely, the circuit constitution here has the amplifying circuit 19 additionally connected instead of the resistor Rx shown in FIG. 1.

A voltage provided by dividing the power source voltage by resistors R1 and R2 is inputted to the non-inversion input terminal of an operational amplifier X7. When the power source voltage is changed, this variation is amplified by the operational amplifier X7 and is outputted from an output terminal of this operational amplifier X7. An amplification degree of the operational amplifier X7 is suitably determined by a feedback resistor Rf, etc. in accordance with a variation of the power source voltage, etc. This output voltage is set to correspond to a wave height value of a triangular wave voltage inputted to the non-inversion input terminal of the comparator X4 and is divided by resistors R4 and R5. This divided voltage is then superposed on a light adjusting signal and is inputted to the inversion input terminal of the comparator X4. A high (H) period of the PWM signal outputted from the comparator X4, i.e., an oscillating period of the ROYER oscillating circuit is controlled in accordance with this amplified variation of the power source voltage, thereby reducing a change in an amount of the electric current flowing through the cold cathode discharge lamp.

Figure 3:
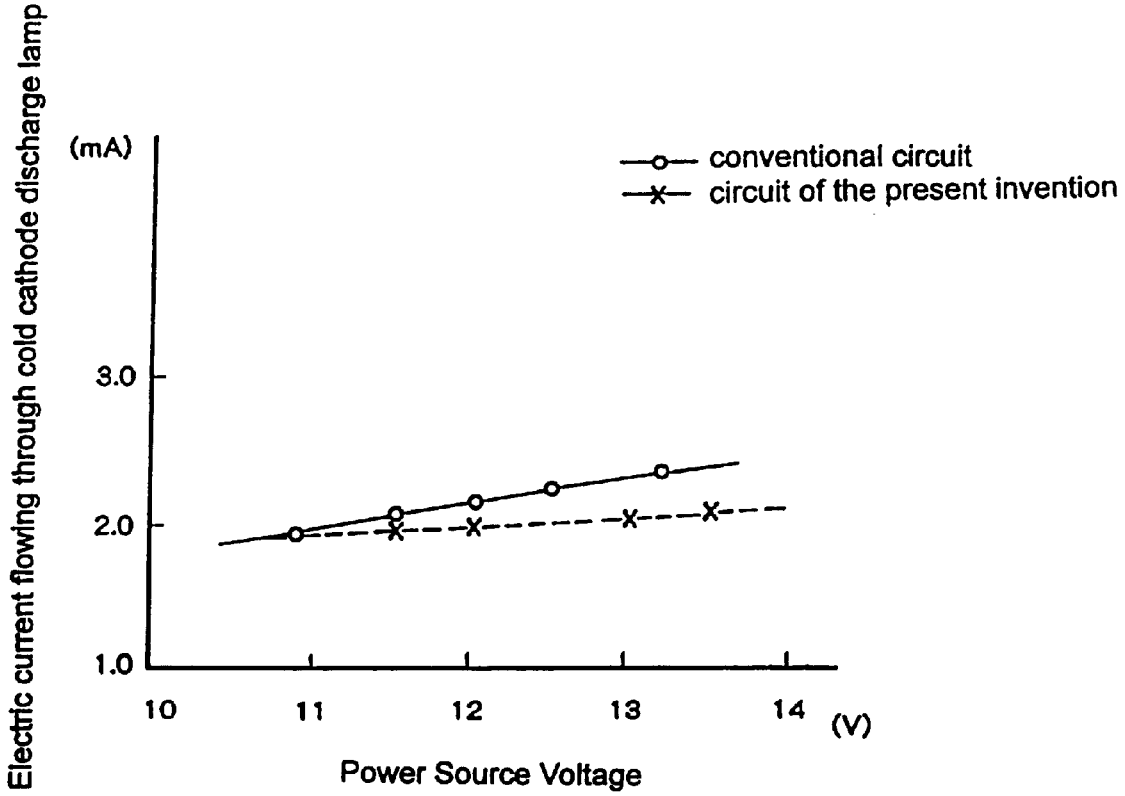
FIG. 3 is a graph showing a change in an electric current flowing through the cold cathode discharge lamp to a change in power source voltage.

In an embodiment 1, the change in the electric current flowing through the cold cathode discharge lamp 11 to the change in the power source voltage (12 V) is measured when the resistor Rx is additionally connected between the inversion input terminal of the comparator X4 and the power source (12 V). FIG. 3 shows the results.

A lower limit voltage of the triangular wave voltage Va generated by operational amplifiers X2, X3 and inputted to the non-inversion input terminal of the comparator X4 is set to 0.5 V. Assuming that the variation of the power source voltage (12 V) ranges from 10.8 to 13.2 V (12±10%), values of resistors Rx and R20 are set such that a voltage divided by the resistors Rx and R20 and applied to both ends of the resistor R20 is equal to 0.5 V when the power source voltage is 10.8 V (in this case, the light adjusting signal voltage at this time is set to 0 V).

The electric current flowing through the cold cathode discharge lamp 11 when the power source voltage varies from 10.8 to 13.2 V is measured for both cases where the resistor Rx is additionally connected and where it is not added (conventional example).

As shown in FIG. 3, the change in the electric current flowing through the cold cathode discharge lamp 11 caused by the change in the power source voltage is reduced in comparison with the conventional example.

Figure 4:
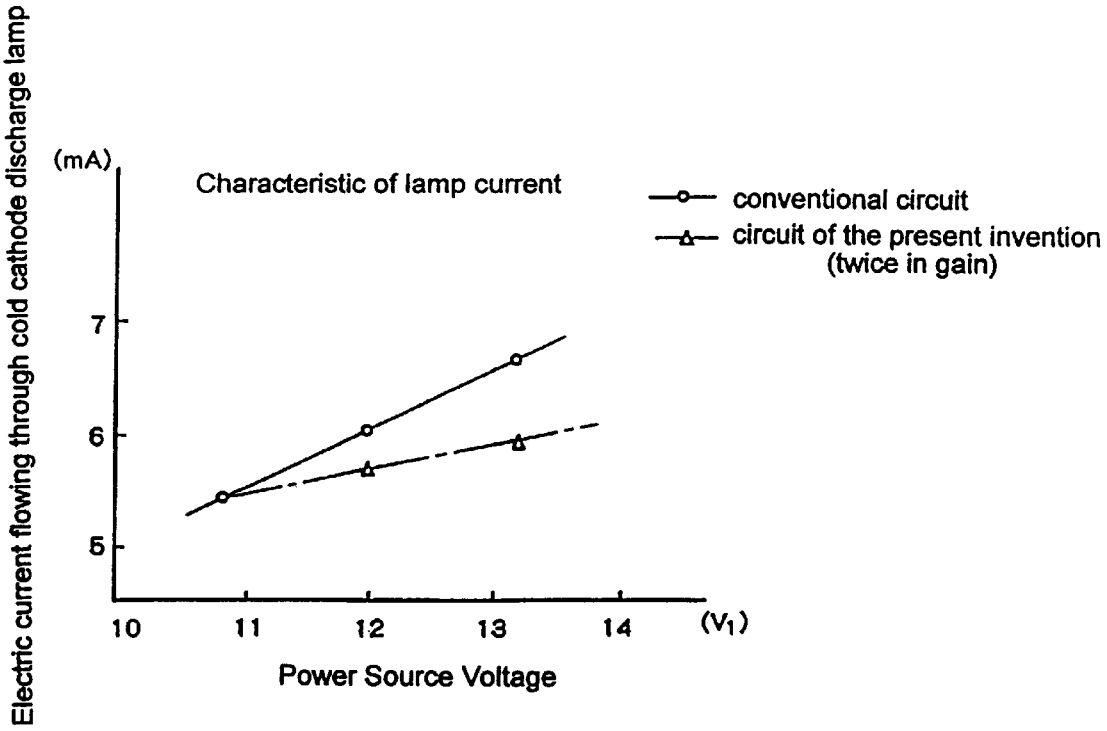
FIG. 4 is a graph showing the change in an electric current flowing through the cold cathode discharge lamp to the change in power source voltage when a circuit different from the one in FIG. 3 is used.
Figure 5:
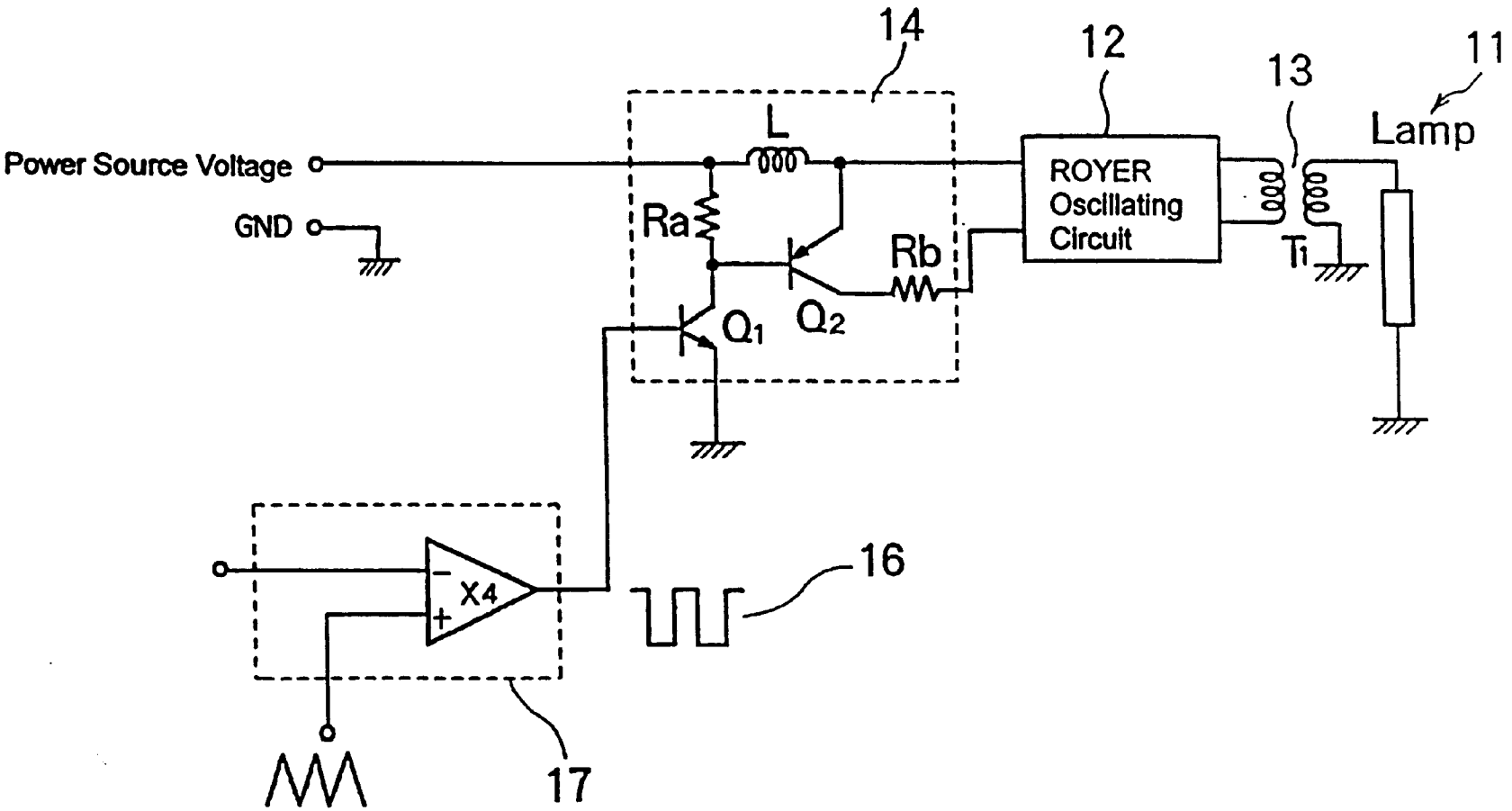
Fig.5 Prior Art
FIG. 5 is a schematic view showing one mode of a lighting circuit of a cold cathode discharge lamp for controlling luminance by a duty light adjusting system, which has been conventionally used.
Figure 6:
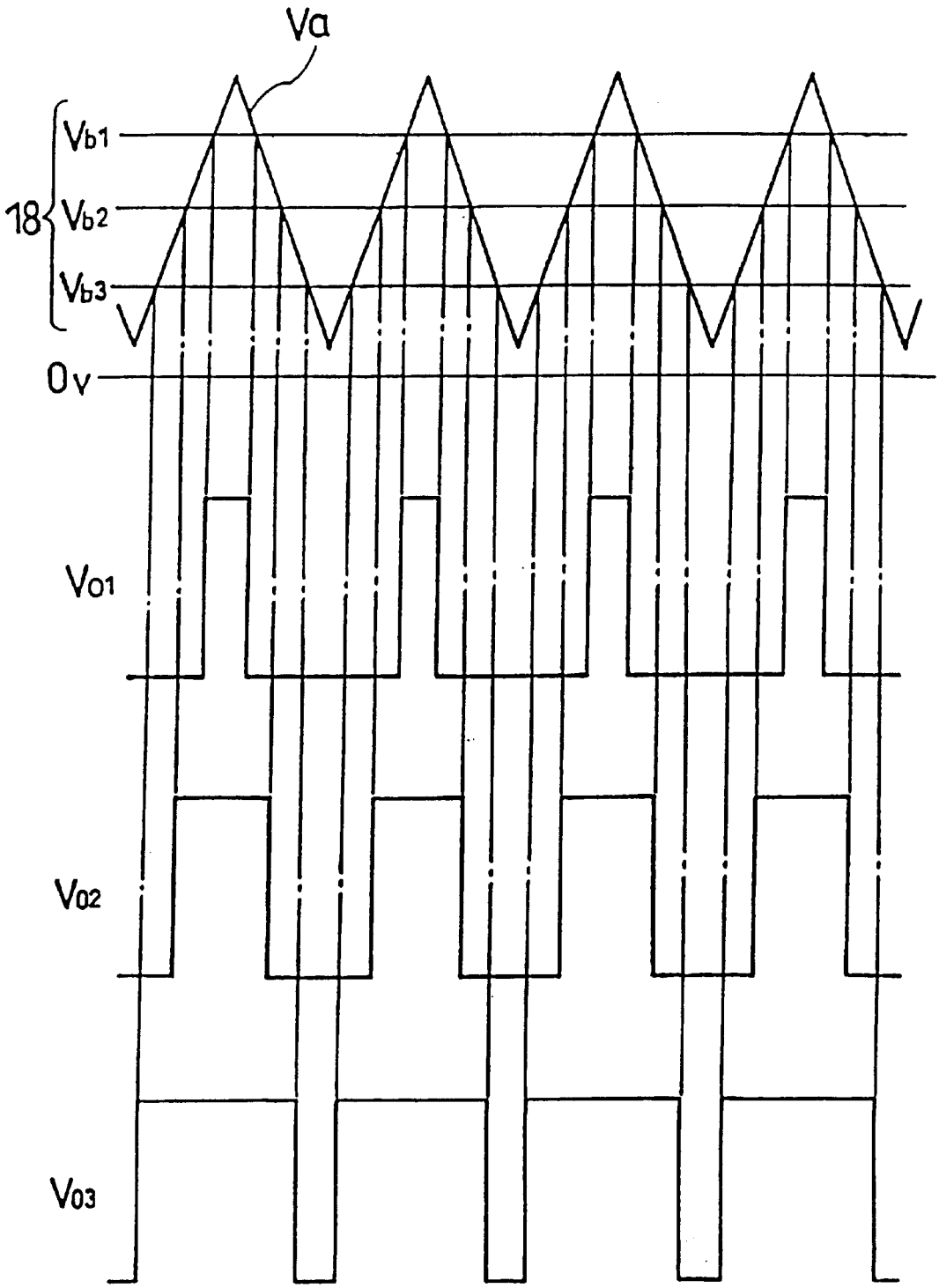
Fig.6 Prior Art
FIG. 6 is a view showing a voltage waveform of each of input terminal and output terminal of a comparator for forming a PWM signal in the lighting circuit of FIG. 5.

In an embodiment 2, the change in the electric current flowing through the cold cathode discharge lamp 11 to the change in the power source voltage (12 V) is measured when the amplifying circuit 19 for amplifying a variation of the power source voltage is additionally connected between the inversion input terminal of the comparator X4 and the power source (12 V). FIG. 4 shows the results.

Similar to the embodiment 1, the triangular wave voltage Va is applied to the inversion input terminal of the operational amplifier X4. The amplification degree of the amplifying circuit 19 is set to 2. When the power source voltage is set to 12 V, a light adjusting signal voltage is adjusted such that an average turning-on electric current flowing through the cold cathode discharge lamp 11 is equal to 6 mA.

The electric current flowing through the cold cathode discharge lamp 11 when the power source voltage varies from 10.8 to 13.2 V is measured for both cases where the amplifying circuit 19 is additionally connected and where it is not added (conventional example).

As shown in FIG. 4, the change in the electric current flowing through the cold cathode discharge lamp 11 caused by the change in the power source voltage is reduced in comparison with the conventional example.

As mentioned above, according to the first aspect of the present invention, a triangular wave voltage is applied to the non-inversion input terminal of a comparator circuit, and a light adjusting signal voltage and a divided power source voltage are superposed and applied to an inversion input terminal of the comparator circuit to form a pulse width modulation signal (PWM signal). Accordingly, an H (high voltage) period of the PWM signal is changed in accordance with a variation of a power source voltage, i.e., a change amount of the divided power source voltage inputted to the above inversion input terminal, and an oscillating period of a ROYER oscillating circuit can be controlled. Therefore, a change of an electric current flowing through the cold cathode discharge lamp can be reduced even when the power source voltage is changed.

According to the second aspect of the present invention, the change in the electric current flowing through the cold cathode discharge lamp can be reduced merely by additionally connecting a resistor between an input terminal of the comparator and a power source. Therefore, the lighting circuit can be manufactured at low cost and can be made compact. Power consumption can be reduced by 10% or more in comparison with the conventional system using a DC/DC converter circuit. Further, since the number of used parts is small, reliability of the lighting circuit is excellent and the life of the product can be lengthened.

According to the third aspect of the present invention, a variation of the power source is amplified by using the amplifying circuit 19 and the high (H) period of the PWM signal is controlled by this voltage. Accordingly, an amplification degree of the amplifying circuit 19 can be suitably set in accordance with a variation of the power source voltage, an amount of the electric current flowing through the cold cathode discharge lamp, etc., so that an optimum control state can be set for every circuit.

What is claimed is:

1. A cold cathode discharge lamp lighting circuit comprising:

a circuit for generating a pulse width modulation signal in accordance with a light adjusting signal level;

a switching circuit turned on and off by the pulse width modulating signal;

a ROYER oscillating circuit oscillated during a turning-on period of said switching circuit;

a transformer for increasing the voltage of an output of said ROYER oscillating circuit; and a cold cathode discharge lamp lighted by the output voltage of said transformer, wherein said circuit for generating the pulse width modulation signal comprises a comparator circuit having a non-inversion input terminal to which a triangular wave voltage is applied and an inversion input terminal to which a voltage provided by superposing a light adjusting signal voltage and a divided power source voltage is applied.

2. The cold cathode discharge lamp lighting circuit as claimed in claim 1, wherein the inversion input terminal of said comparator circuit is connected to a power source through a resistor.

3. The cold cathode discharge lamp lighting circuit as claimed in claim 1, wherein the voltage applied to the inversion input terminal of said comparator circuit is a voltage provided by superposing the light adjusting voltage and a voltage provided by amplifying a variation of the power source voltage.

* * * * *